US011408680B2

(12) United States Patent
Adomat

(10) Patent No.: US 11,408,680 B2
(45) Date of Patent: Aug. 9, 2022

(54) SYSTEM FOR COOLING A FLUID WITH A MICROCHANNEL EVAPORATOR

(71) Applicant: Hyfra Industriekuhlanlagen GmbH, Krunkel (DE)

(72) Inventor: Berthold Adomat, Krunkel (DE)

(73) Assignee: Hyfra Industriekuhlanlagen GmbH, Krunkel (DE)

( * ) Notice: Subject to any disclaimer, the term of this patent is extended or adjusted under 35 U.S.C. 154(b) by 144 days.

(21) Appl. No.: 16/775,759

(22) Filed: Jan. 29, 2020

(65) Prior Publication Data

US 2020/0166279 A1 May 28, 2020

Related U.S. Application Data

(63) Continuation of application No. 15/298,691, filed on Oct. 20, 2016, now Pat. No. 10,619,932.
(Continued)

(51) Int. Cl.
*F28D 1/047* (2006.01)
*F28D 1/053* (2006.01)
(Continued)

(52) U.S. Cl.
CPC ..... *F28D 1/0476* (2013.01); *F28D 1/0213* (2013.01); *F28D 1/0471* (2013.01); *F28D 1/0475* (2013.01); *F28D 1/05383* (2013.01); *F28D 7/06* (2013.01); *F28F 9/001* (2013.01); *F28F 19/04* (2013.01); *F28F 19/06* (2013.01);
(Continued)

(58) Field of Classification Search
CPC ..... F28D 1/0477; F28D 1/0476; F28D 7/06; F28D 1/0475; F28D 1/0213; F28D 1/05383; F28D 2021/0071; F28D 2021/0085; F28F 9/001; F28F 19/04; F28F 19/06;
(Continued)

(56) References Cited

U.S. PATENT DOCUMENTS 4,210,202 A 7/1980 Boyer et al.
4,579,304 A 4/1986 Williams
(Continued)

FOREIGN PATENT DOCUMENTS

DE 2638468 A1 3/1977
DE 3328311 A1 2/1985
(Continued)

OTHER PUBLICATIONS

JP 53106962 A MT (Year: 1978).*
(Continued)

*Primary Examiner* — Gordon A Jones
(74) *Attorney, Agent, or Firm* — Shackelford, Bowen, Mckinley & Norton, LLP

(57) ABSTRACT

A microchannel evaporator includes a plurality of microchannels. Each of the plurality of microchannels includes a first end and a second end. A first end-tank is coupled to each first end of the plurality of microchannels and a second end-tank is coupled to each second end of the plurality of microchannels. An inlet is coupled to the first end-tank for receiving a fluid into the microchannel evaporator and an outlet is coupled to the second end-tank for expelling the fluid from the microchannel evaporator. Each microchannel of the plurality of microchannels is substantially U-shaped.

18 Claims, 7 Drawing Sheets

Related U.S. Application Data

(60) Provisional application No. 62/245,370, filed on Oct. 23, 2015.

(51) Int. Cl.

| | |
|---|---|
| ***F28D 7/06*** | (2006.01) |
| ***F28D 1/02*** | (2006.01) |
| ***F28F 9/00*** | (2006.01) |
| ***F28F 19/04*** | (2006.01) |
| ***F28F 19/06*** | (2006.01) |
| *F28D 21/00* | (2006.01) |
| *F28F 9/22* | (2006.01) |

(52) U.S. Cl.
CPC ..... *F28D 2021/0071* (2013.01); *F28D 2021/0085* (2013.01); *F28F 2009/224* (2013.01); *F28F 2009/226* (2013.01); *F28F 2260/02* (2013.01)

(58) Field of Classification Search
CPC ..... F28F 9/0202; F28F 2009/224; F28F 2009/226; F28F 2260/02
See application file for complete search history.

(56) References Cited

U.S. PATENT DOCUMENTS

| | | | | |
|---|---|---|---|---|
| 4,839,951 | A | 6/1989 | Boula et al. | |
| 4,966,230 | A | 10/1990 | Hughes et al. | |
| 5,296,199 | A * | 3/1994 | Kwok | F28F 9/0202 165/145 |
| 6,126,079 | A | 10/2000 | Shoemaker | |
| 6,546,999 | B1 | 4/2003 | Dienhart et al. | |
| 7,013,953 | B2 * | 3/2006 | Jung | F28D 7/087 165/95 |
| 7,267,160 | B2 | 9/2007 | Shincho et al. | |
| 7,667,057 | B2 | 2/2010 | Regiert et al. | |
| 7,779,898 | B2 | 8/2010 | Morrison et al. | |
| 7,921,904 | B2 | 4/2011 | Matter et al. | |
| 9,562,727 | B2 | 2/2017 | Fujii et al. | |
| 10,132,538 | B2 | 11/2018 | Fritz | |
| 2003/0000686 | A1 * | 1/2003 | Kester | F28F 1/325 165/151 |
| 2003/0066632 | A1 | 4/2003 | Bishop et al. | |
| 2004/0261983 | A1 | 12/2004 | Hu | |
| 2005/0056049 | A1 | 3/2005 | Sanada | |
| 2005/0173102 | A1 | 8/2005 | Jung | |
| 2005/0217831 | A1 | 10/2005 | Manaka | |
| 2006/0102332 | A1 | 5/2006 | Taras et al. | |
| 2009/0013676 | A1 * | 1/2009 | Capelle | F28D 7/1692 165/172 |
| 2009/0084131 | A1 | 4/2009 | Reifel et al. | |
| 2009/0084532 | A1 | 4/2009 | Agee | |
| 2009/0173102 | A1 | 7/2009 | Ogasawara | |
| 2009/0173483 | A1 | 7/2009 | Beamer et al. | |
| 2009/0277606 | A1 * | 11/2009 | Reiss, III | F28F 9/013 165/69 |
| 2010/0263847 | A1 | 10/2010 | Alahyari et al. | |
| 2011/0107512 | A1 | 5/2011 | Gilbert | |
| 2011/0284185 | A1 | 11/2011 | Cullen et al. | |
| 2012/0151950 | A1 * | 6/2012 | Jagusztyn | F28D 7/1684 62/228.1 |
| 2012/0193080 | A1 | 8/2012 | Rasmussen | |
| 2013/0068606 | A1 | 3/2013 | Lahnstein | |
| 2013/0098591 | A1 | 4/2013 | Taras et al. | |
| 2013/0213073 | A1 | 8/2013 | Fritz et al. | |
| 2014/0090827 | A1 | 4/2014 | Iguchi et al. | |
| 2014/0262188 | A1 | 9/2014 | Sistla | |
| 2016/0010905 | A1 | 1/2016 | Wang et al. | |
| 2016/0377348 | A1 | 12/2016 | Fujisawa et al. | |
| 2017/0115066 | A1 | 4/2017 | Adomat | |
| 2017/0254605 | A1 | 9/2017 | Blomgren | |
| 2018/0051945 | A1 | 2/2018 | Hanov et al. | |

FOREIGN PATENT DOCUMENTS

| | | | | |
|---|---|---|---|---|
| DE | 19703729 | C1 | 7/1998 | |
| DE | 102006050922 | A1 | 4/2008 | |
| EP | 1607707 | A1 | 12/2005 | |
| EP | 3029407 | A1 | 6/2016 | |
| EP | 3159645 | A1 | 4/2017 | |
| FR | 2914407 | A1 | 10/2008 | |
| GB | 1365297 | A * | 8/1974 | F28D 7/06 |
| JP | 53106962 | A * | 9/1978 | F28D 7/06 |
| WO | WO-2010011452 | A2 | 1/2010 | |
| WO | WO-2011115626 | A1 | 9/2011 | |
| WO | WO-2016009565 | A1 | 1/2016 | |

OTHER PUBLICATIONS

U.S. Appl. No. 15/298,691, Adomat.
U.S. Appl. No. 15/298,720, Adomat.
U.S. Appl. No. 16/378,884, Lahnstein et al.

* cited by examiner

SYSTEM FOR COOLING A FLUID WITH A MICROCHANNEL EVAPORATOR

CROSS-REFERENCE TO RELATED APPLICATIONS

This application is a continuation of U.S. patent application Ser. No. 15/298,691, filed on Oct. 20, 2016. U.S. patent application Ser. No. 15/298,691 claims priority from U.S. Provisional Patent Application No. 62/245,370, filed on Oct. 23, 2015. U.S. patent application Ser. No. 15/298,691 and U.S. Provisional Patent Application No. 62/245,370 are incorporated herein by reference.

TECHNICAL FIELD

The present invention relates generally to heat exchangers and more particularly, but not by way of limitation, to a microchannel evaporator ("MCE").

BACKGROUND

Machines with moving parts often make use of a fluid (e.g., oil) to lubricate the moving parts and to provide a medium to dissipate some of the heat that may be generated from operation of the machine. The dissipation of heat from the machine may be improved by circulating the fluid from the machine to an external cooling apparatus, such as a heat exchanger.

One method for cooling the fluid of the machine is to use a coiled-tube heat exchanger. An example of a coiled-tube heat exchanger is shown in FIGS. 1A and 1B. Coiled-tube heat exchangers, while effective at removing heat from a fluid, have certain drawbacks. For example, coiled-tube heat exchangers can be difficult and expensive to manufacture. Furthermore, coiled-tube heat exchangers can also be difficult to clean due to their compact bundling of the coiled tubes.

SUMMARY

A microchannel evaporator includes a plurality of microchannels. Each of the plurality of microchannels includes a first end and a second end. A first end-tank is coupled to each first end of the plurality of microchannels and a second end-tank is coupled to each second end of the plurality of microchannels. An inlet is coupled to the first end-tank for receiving a fluid into the microchannel evaporator and an outlet is coupled to the second end-tank for expelling the fluid from the microchannel evaporator. Each microchannel of the plurality of microchannels is substantially U-shaped.

A heat exchanger system includes a fluid tank and a lid adapted to seal the fluid tank. The lid includes a first-fluid inlet to permit a first fluid to enter the fluid tank and a first-fluid outlet to permit the first fluid to exit the fluid tank. The system also includes a microchannel evaporator disposed within the fluid tank. The microchannel evaporator includes a plurality of microchannels that each has a first end and a second end. A first end-tank is coupled to each first end of the plurality of microchannels and a second end-tank is coupled to each second end of the plurality of microchannels. A second-fluid inlet is coupled to the first end-tank for receiving a second fluid into the microchannel evaporator and a second-fluid outlet is coupled to the second end-tank for expelling the second fluid from the microchannel evaporator. Each microchannel of the plurality of microchannels is spaced apart from an adjacent microchannel of the plurality of microchannels such that at least one gap is formed between each microchannel.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Various embodiments of the present invention will now be described more fully with reference to the accompanying drawings. The invention may, however, be embodied in many different forms and should not be construed as limited to the embodiments set forth herein.

Figure 1B:
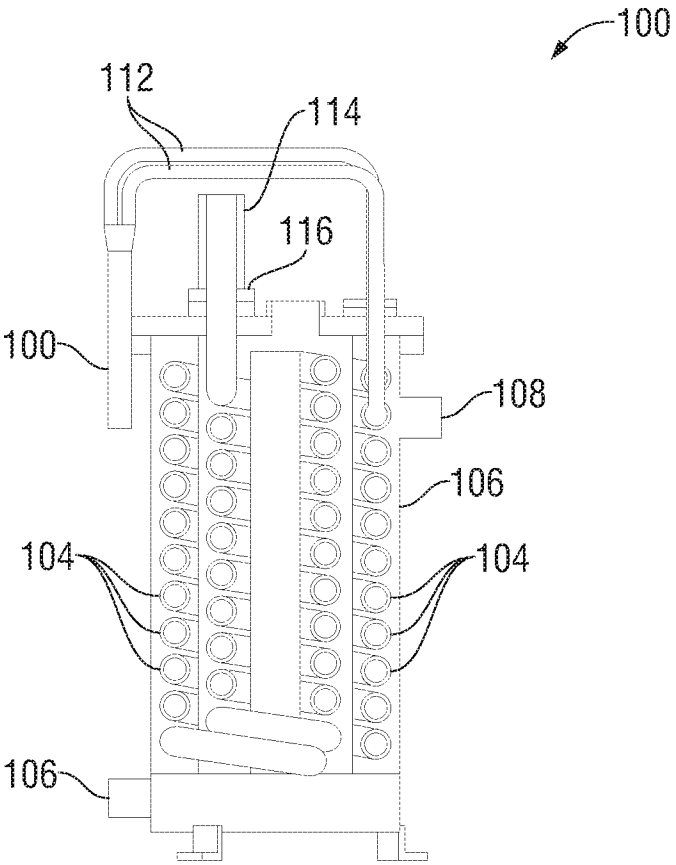
FIG. 1B (Prior Art)
FIGS. 1A and 1B illustrate a prior art coiled-tube heat exchanger system.
Figure 1A:
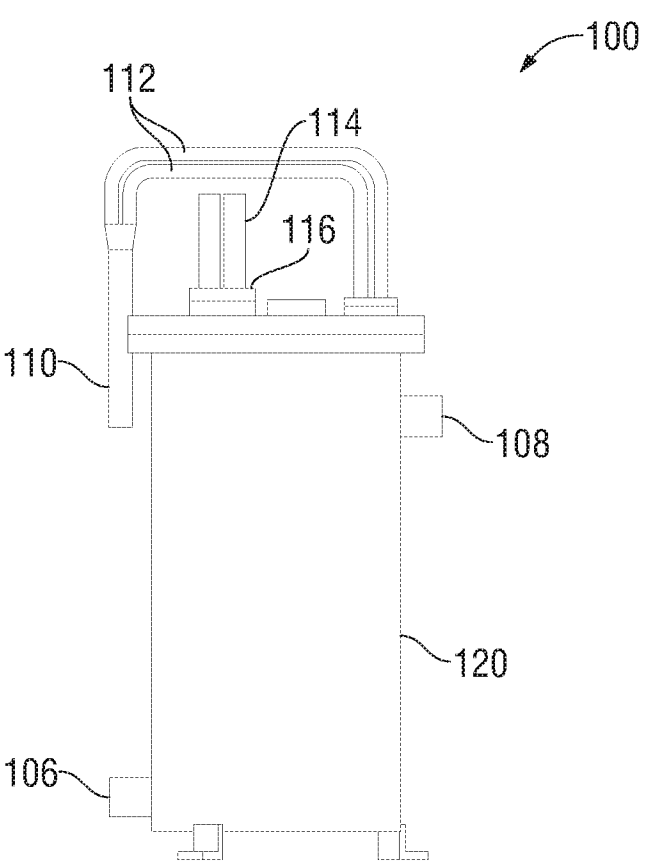
FIG. 1A (Prior Art)

FIGS. 1A and 1B illustrate a prior art coiled-tube heat exchanger system 100. FIG. 1A is a front view of the coiled-tube heat exchanger system 100 and FIG. 1B is a cross-sectional view of the coiled-tube heat exchanger system 100. The coiled-tube heat exchanger system 100 includes a fluid tank 120 in which a series of coiled tubes 104 are submerged. In some embodiments, the fluid tank 120 may be a pot or other container for circulating a first fluid from a machine therethrough. The first fluid from the machine may be, for example, oil. In general, the first fluid may be any fluid that needs to be cooled. The fluid tank 120 includes a fluid tank inlet 106 for receiving the first fluid from the machine and a fluid tank outlet 108 for returning the first fluid to the machine. In some embodiments, the fluid tank 120 is open to the atmosphere. In other embodiments, the fluid tank 120 is sealed and pressure within the fluid tank 120 may be controlled as desired. The series of coiled tubes 104 direct a second fluid therethrough and may include one or more tubes, each of which is bent to form a coil that fits within the fluid tank 120. The second fluid may be a coolant or refrigerant (e.g., R410A) that is used to absorb heat from the first fluid to cool the first fluid. The second fluid is fed to the coiled-tube heat exchanger system 100 from a cooling system. Any cooling system may be used provided that the cooling system provides enough cooling duty to absorb a desired amount of heat from the first fluid. The term "first fluid" is used throughout to describe a fluid that is to be cooled and the term "second fluid" is used throughout to describe a fluid that is used to absorb heat from the first fluid.

As shown in FIGS. 1A and 1B, a main inlet tube 110 branches off into multiple sub-inlet tubes 112. The sub-inlet tubes 112 are directed into the fluid tank 120 where they begin to bend to form the series of coiled tubes 104. Ends of the series of coiled tubes 104 connect to a manifold 114 that includes an outlet 116 that returns the second fluid to the cooling system. Once the second fluid has been returned to the cooling system, the cooling system removes the absorbed heat from the first fluid so that the second fluid may be recirculated back to the coiled-tube heat exchanger system 100.

During typical operation of the coiled-tube heat exchanger system 100, the first fluid passing through the fluid tank 120 is cooled by passing a second fluid through the main inlet tube 110 and into the sub-inlet tubes 112. In a typical embodiment, the second fluid is a coolant or a refrigerant (e.g., R410A). As the first fluid within the fluid tank 120 passes around the series of coiled tubes 104, heat is absorbed from the first fluid and transferred into the second fluid. While the use of the series of coiled tubes 104 may be an effective solution to generally remove heat from the first fluid, the assembly and operation of a coiled-tube evaporator has inherent complications. For example, due to the overlap among the tubes of the series of coiled tubes 104, it may be difficult to clean debris and sediment from the first fluid that becomes deposited on and around the series of coiled tubes 104. Furthermore, each end of each of the series of coiled tube 104 must be attached to the main inlet tube 110 to seal a flow path for the second fluid to pass through. These attachments make assembly of the coiled-tube heat exchanger system 100 more complicated, and each of the connections increases the potential for formation of a leak.

Figure 2:
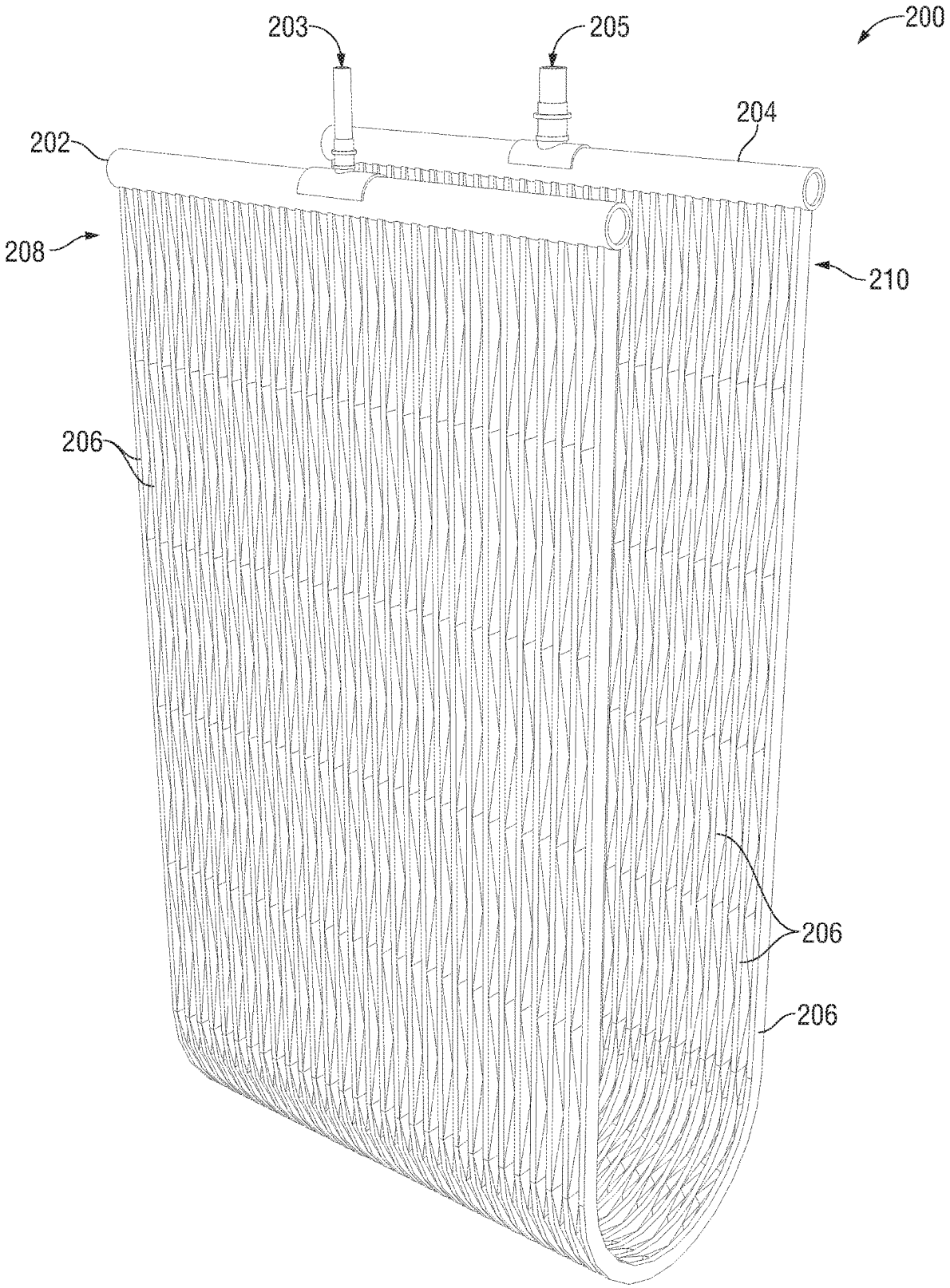
FIG. 2 is an isometric view of an exemplary microchannel evaporator.

FIG. 2 is an isometric view of an exemplary MCE 200. In a typical embodiment, the MCE 200 is substantially U-shaped and includes a first end-tank 202 and a second end-tank 204, which are disposed at opposite ends of the substantially "U" shaped MCE 200. Substantially U-shaped is used herein to mean that each microchannel includes end portions that are generally parallel to one another. The first end-tank 202 includes an inlet 203 through which the second fluid may be introduced into the MCE 200. In a typical embodiment, the second fluid is a coolant or a refrigerant (e.g., R410A). In general, the second fluid can be any fluid that is able to absorb heat from the first fluid. The second end-tank 204 includes an outlet 205 through which the second fluid may exit the MCE 200. The second fluid is communicated from the first end-tank 202 to the second end-tank 204, for example, via a plurality of microchannels 206. The first end-tank 202 and the second end-tank 204 act as manifolds that distribute and collect the second fluid, respectively, to and from the plurality of microchannels 206. Each of the plurality of microchannels 206 is coupled at a first end 208 to the first end-tank 202 and at a second end 210 to the second end-tank 204. The number of microchannels 206 included in the plurality of microchannels 206 is a matter of design choice. More or fewer microchannels 206 could be incorporated as desired.

In comparison to the coiled-tube heat exchanger system 100 of FIGS. 1A and 1B, the MCE 200 includes one inlet 203 and one outlet 205. The reduction in the number of inlets/outlets to just one of each makes the assembly process easier and increases reliability of the MCE 200 by reducing the number of potential leak points. A further benefit of the MCE 200 is that, compared to the coiled-tube heat exchanger system 100, the MCE 200 uses a reduced amount of the second fluid. In some embodiments, a reduction in the amount of the second fluid needed is as high as 60-70%. This reduction is possible because a total volume of the sub-inlet tubes 112 of the coiled-tube heat exchanger system 100 is typically much greater than a volume of the plurality of microchannels 206. Reduction of the amount of the second fluid used is desirable from both a cost perspective and an environmental perspective.

Another benefit of the MCE 200 over the coiled-tube heat exchanger system 100 is that the amount of labor to assemble the MCE 200 is greatly reduced in comparison with the coiled-tube heat exchanger system 100. Due to the complex geometries involved, manufacturing the parts for the coiled-tube heat exchanger system 100 and assembly thereof is difficult and expensive compared to the MCE 200.

Figure 3:
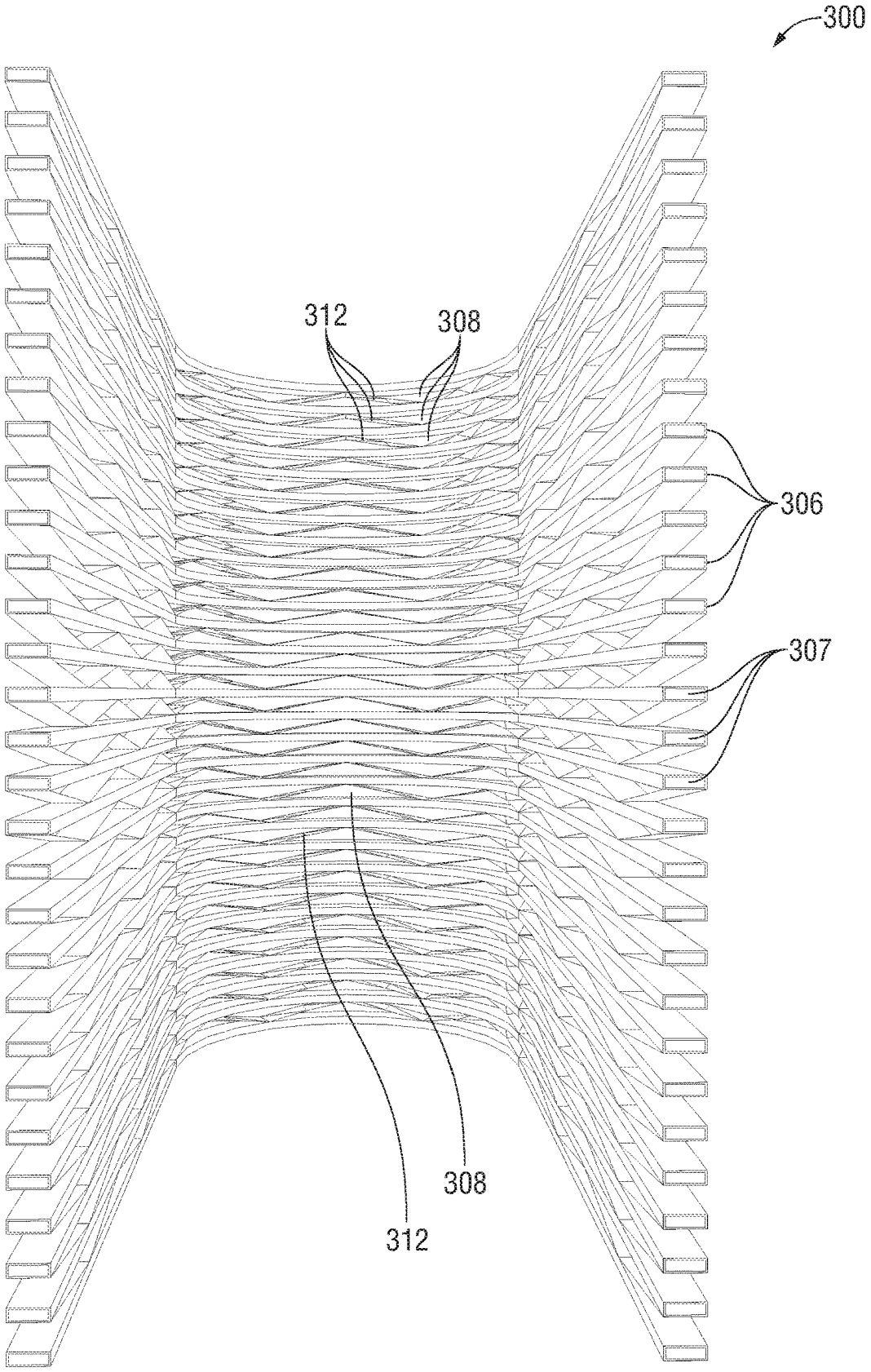
FIG. 3 illustrates a cross-sectional view of an exemplary microchannel evaporator.

FIG. 3 illustrates a cross-sectional view of an exemplary MCE 300. The MCE 300 is similar to the MCE 200 and the description of the features and design of the MCE 300 generally applies to the MCE 200 as well. As shown in FIG. 3, the MCE 300 includes a plurality of microchannels 306. Each microchannel 306 includes a fluid conduit 307 through which the second fluid may flow. FIG. 3 also illustrates fins 312 that are disposed between adjacent microchannels 306. The fins 312 help conduct heat from the first fluid to the second fluid by increasing the surface area contacted by the first fluid as it flows around the microchannels 306. In some embodiments, the fins 312 are spaced widely apart, such as, for example, 5 to 8.5 fins per inch, so as not to appreciably slow the flow of the first fluid through gaps 308 between the plurality of microchannels 306. Spacing the fins 312 widely apart also makes it easier to clean debris and sediment that may have settled upon the fins 312 and the plurality of microchannels 306. In other embodiments, the fins 312 may be spaced less widely apart in order to increase the surface area contacted by the first fluid to increase heat transfer from the first fluid to the second fluid within the plurality of microchannels 306. In some embodiments, the fins 312 may only be disposed along a portion of the length of the microchannels 306. In other embodiments, the MCE 300 may not include any fins 312.

In a typical embodiment, the plurality of microchannels 306 have a rectangular cross-section. In other embodiments, the plurality of microchannels 306 may have other cross-sectional shapes, such as, for example, square, round, and the like. The plurality of microchannels 306 shown herein are not necessarily drawn to scale. The dimensions of the plurality of microchannels 306 can vary depending on the embodiment. For example, width, height, and length of the plurality of microchannels 306 can be changed in accordance with design preferences. The distance between the plurality of microchannels 306 that defines the size of the gaps 308 between each of the microchannels 306 may also be varied as desired.

Various types of refrigerants may be used in connection with the MCE 300, such as, for example, R410A. When using a refrigerant as the second fluid, the refrigerant that passes through the MCE 300 may enter an inlet of the MCE 300 as a liquid and exit an outlet of the MCE 300 as a vapor. The phase transformation from liquid to vapor results from the addition of heat from the first fluid to the refrigerant. In such an embodiment, the outlet may have a larger diameter than the inlet to compensate for the increased volume of the gas phase relative to the liquid phase.

Figure 4A:
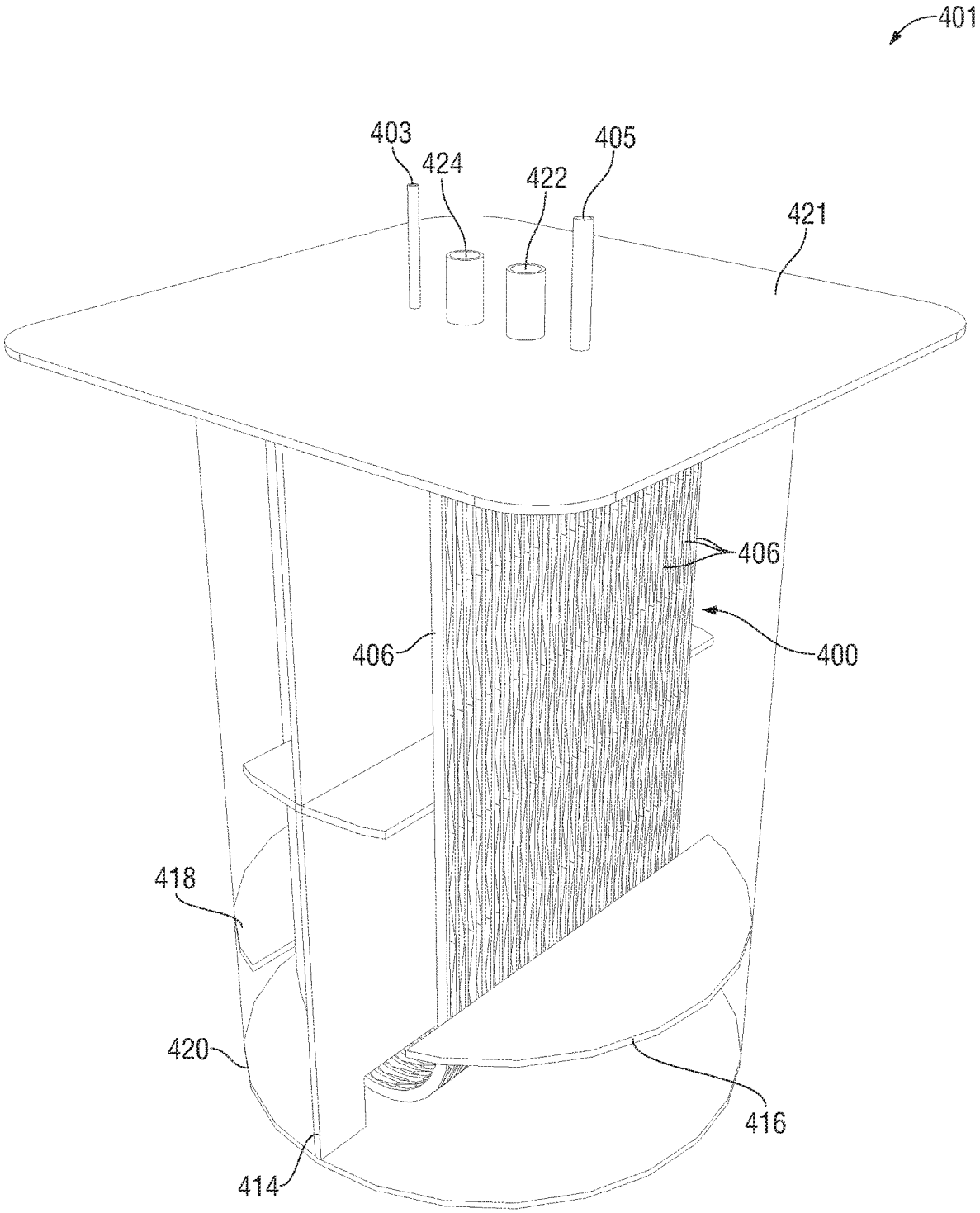
FIGS. 4A-4C illustrate isometric, front, and cross-sectional views, respectively, of an exemplary microchannel evaporator heat exchanger system.
Figure 4B:
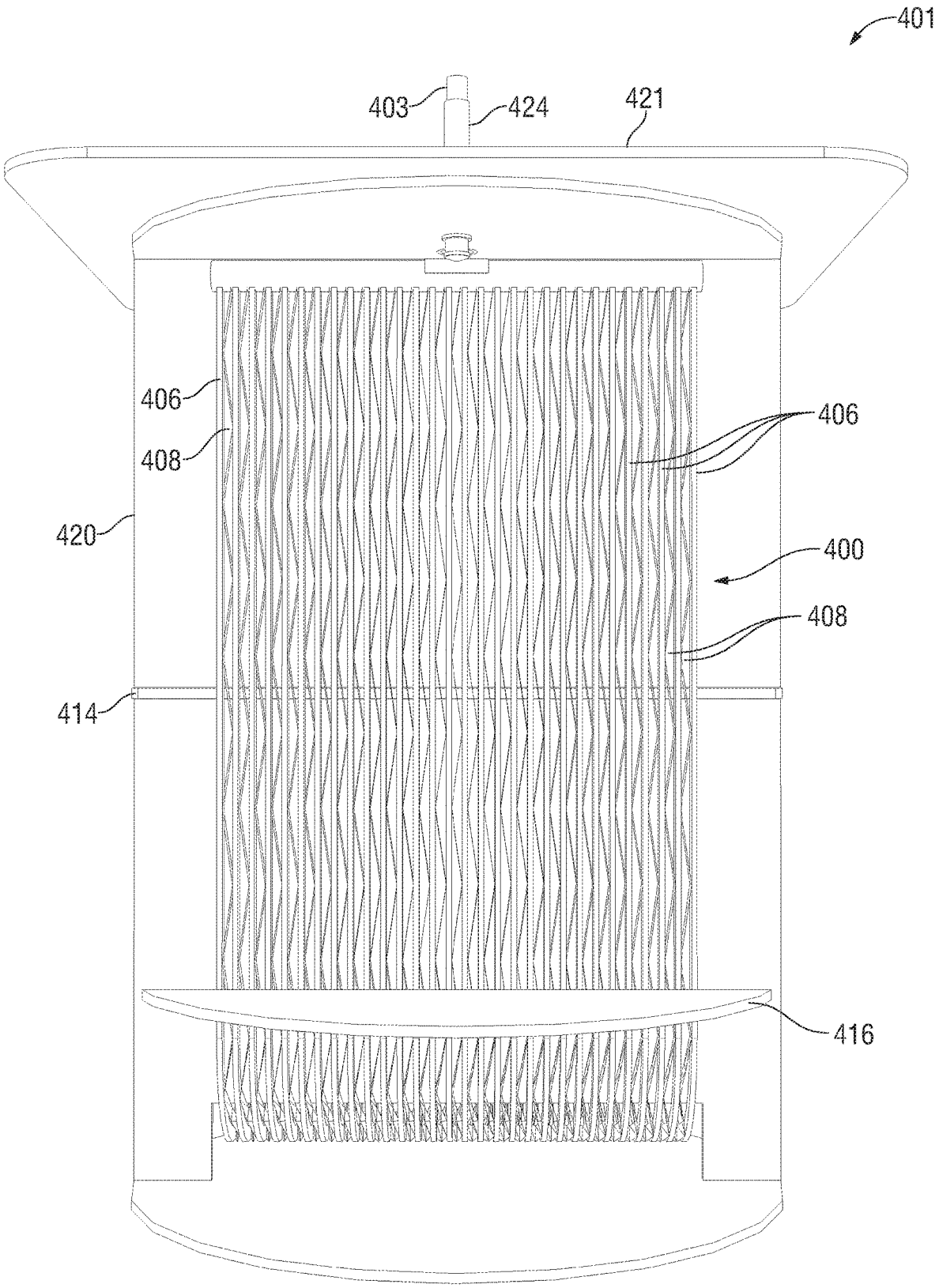
Figure 4C:
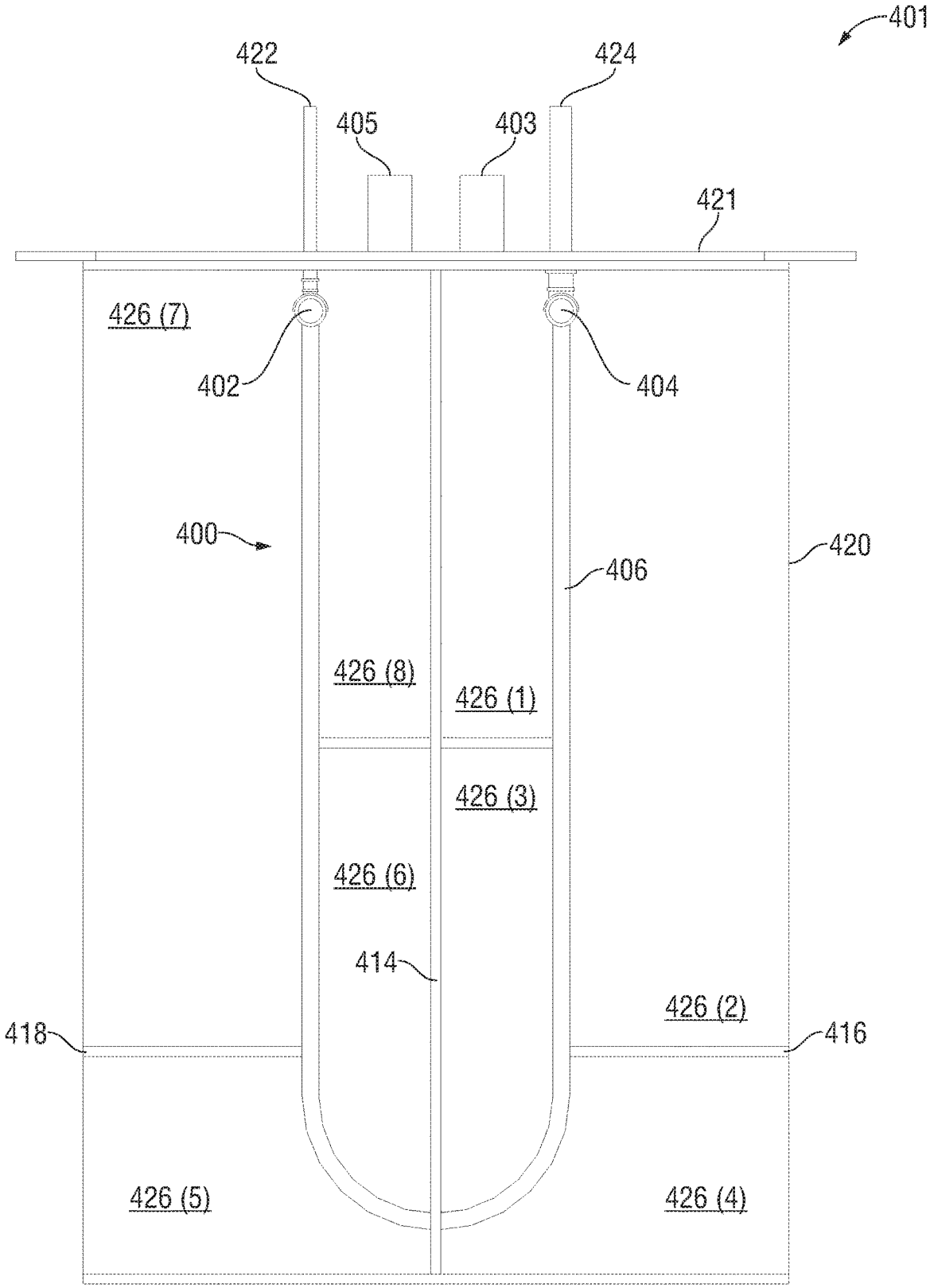

FIGS. 4A-4C illustrate isometric, front, and cross-sectional views, respectively, of an exemplary MCE heat exchanger system 401. The MCE heat exchanger system 401 includes an MCE 400 and a fluid tank 420. The MCE 400 is similar to the MCEs 200 and 300, and includes a first end-tank 402, a second-fluid inlet 403, a second end-tank 404, a second-fluid outlet 405, and a plurality of microchannels 406.

As shown in FIGS. 4A-4C, the MCE 400 is inserted into the fluid tank 420. In a typical embodiment, the fluid tank 420 includes a lid 421 that covers the fluid tank 420. The lid 421 seals the fluid tank 420 so that the fluid tank 420 may be pressurized if desired. In a typical embodiment, the lid 421 includes a first-fluid inlet 422 and a first-fluid outlet 424.

The first-fluid inlet 422 and first-fluid outlet 424 permit the first fluid to flow in and out, respectively, of the fluid tank 420. During operation of the MCE heat exchanger system 401, the first fluid enters the fluid tank 420 through the first-fluid inlet 422 and flows around the MCE 400 to exchange heat with the second fluid contained therein. After passing through the fluid tank 420, the first fluid exits through the first-fluid outlet 424. In a typical embodiment, a second-fluid inlet 403 of the MCE 400 is positioned near the first-fluid outlet 424 and a second-fluid outlet 405 of the MCE 400 is positioned near the first-fluid inlet 422 like a typical countercurrent or counter-flow heat exchanger.

The lid 421 includes provisions for the second-fluid inlet 403 and the second-fluid outlet 405 to pass through so that the second fluid can be circulated through the MCE 400. In a typical embodiment, the provisions comprise holes that are sized to accommodate the second-fluid inlet 403 and the second-fluid outlet 405. In order to form a pressure tight seal around the second-fluid inlet 403 and second-fluid outlet 405, gaskets can be used to seal the lid 421 around the second-fluid inlet 403 and the second-fluid outlet 405. In other embodiments, the second-fluid inlet 403 and the second-fluid outlet 405 may be joined to the lid 421 via pressure-tight connectors. In a typical embodiment, the lid 421 is sealed relative to the fluid tank 420 so that the MCE heat exchanger system 401 may be pressurized. The a seal between the lid 421 and the fluid tank 420 may be formed via various mechanisms, such as, for example, bolts, latches, gaskets, and the like.

The second fluid enters the MCE 400 through the second-fluid inlet 403 and exits the MCE 400 through the second-fluid outlet 405. As the first fluid flows around the plurality of microchannels 406, heat from the first fluid in the fluid tank 420 is absorbed by the second fluid in the MCE 400, thereby reducing the first fluid's temperature. When refrigerant is used as the second fluid, a phase change from liquid to gas may occur as a result of the absorption of heat from the fluid.

As shown in FIGS. 4A-4C, the MCE heat exchanger system 401 includes a first baffle 414 that is disposed in a central area of the fluid tank 420, between vertical portions of the U-shaped MCE 400. The MCE heat exchanger system 401 also includes a second baffle 416 and a third baffle 418 that are disposed on opposite sides of the baffle 416. The first baffle 414, the second baffle 416, and the third baffle 418 work together to direct a flow of the first fluid through the fluid tank 420 so that the first fluid must make several passes through gaps 408 that are formed between the plurality of microchannels 406. As shown in FIGS. 4A-4C, the first baffle 414, the second baffle 416, and the third baffle 418 divide the fluid tank 420 into eight chambers 426(1)-426(8). First fluid entering the fluid tank 420 enters through the first-fluid inlet 422 into chamber 426(1). Because of the placement of the first baffle 414, the first fluid must flow through the gaps 408 between the plurality of microchannels 406 into chamber 426(2), thereby passing through the gaps 408 of the MCE 400 a first time. From the chamber 426(2), the second baffle 416 directs the first fluid back through the gaps 408 between the plurality of microchannels 406 and into the chamber 426(3), thereby passing through the gaps 408 of the MCE 400 a second time. In a similar manner, the first fluid continues its flow through the fluid tank 420 entering each of chambers 426(4)-426(8) and then exiting the fluid tank 420 through the first-fluid outlet 424. After the first fluid has passed through the MCE heat exchanger system 401, the first fluid will have passed from one side of the MCE 400 to the other side of the MCE 400 six times.

The arrangement of the first baffle 414, the second baffle 416, and the third baffle 418 shown in FIGS. 4A-4C illustrate one possible arrangement for the MCE heat exchanger system 401. A person having skill in the art will recognize that more or fewer baffles may be used to create more or fewer chambers as desired. In some arrangements, the baffles may be excluded all together. Depending on the type of first fluid being cooled and upon the type of second fluid being used, flow rates of the first fluid and the second fluid may be adjusted as desired. A size of the fluid tank 420 and the MCE 400 may also be increased or decreased to insure that the MCE 400 provides the desired cooling capacity for the first fluid being cooled. A person having skill in the art will recognize that the size of the fluid tank 420 and the MCE 400 may be increased to provide additional cooling capacity. Similarly, additional MCE heat exchanger systems 401 may be used in either parallel or series to provide increased cooling capacity.

Figure 5:
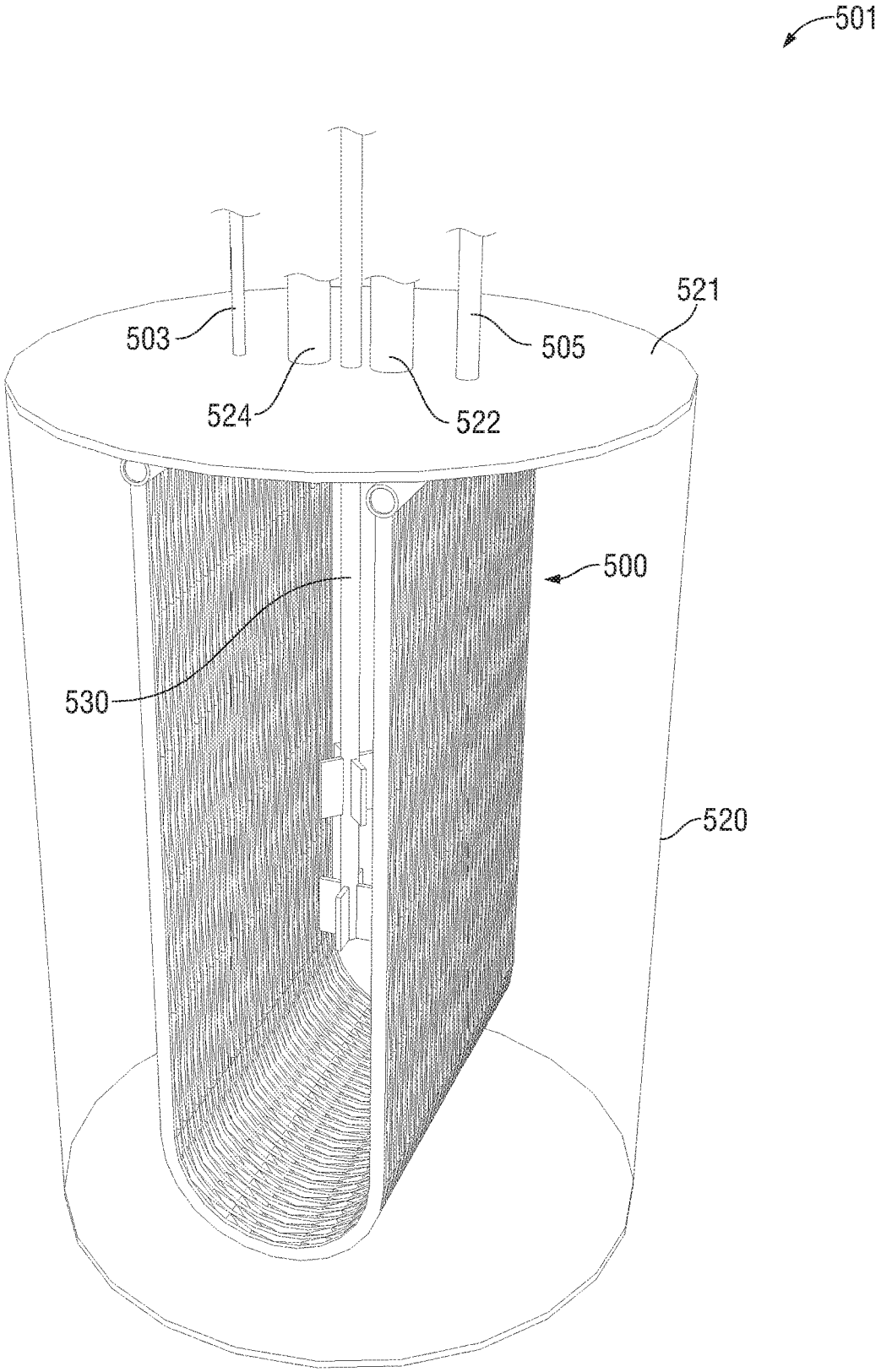
FIG. 5 illustrates a microchannel evaporator that includes an agitator.

FIG. 5 illustrates an exemplary MCE system 501 that includes an agitator 530. The MCE system 501 is generally similar to the MCE heat exchanger system 401, and includes similar features. For example, the MCE system 501 includes an MCE 500 and a fluid tank 520, each of which is similar to the MCE 400 and fluid tank 420, respectively. The MCE system 501 further includes an agitator 530. In a typical embodiment, the agitator 530 is configured to cause turbulence to a flow of the first fluid through the fluid tank 502. In a typical embodiment, the MCE system 501 includes a lid 521 that is similar to the lid 421. In a typical embodiment, the lid 521 includes a first-fluid inlet 522 and a first-fluid outlet 524. The first-fluid inlet 522 and first-fluid outlet 524 permit the first fluid to flow in and out, respectively, of the fluid tank 520. Second fluid enters the MCE 500 via a second-fluid inlet 503 and exits the MCE 500 via a second-fluid outlet 505.

The agitator 530, as shown in FIG. 5 is an impeller. In other embodiments, the agitator 530 may be another type of agitator, such as, for example, a pump wheel agitator, a mixer, and the like. The agitator 530 may operate at various speeds depending on the type of agitator used and the amount of fluid movement desired. In some embodiments, a pump wheel agitator may operate at a speed of approximately 3,000 rpms. In one embodiment, the agitator 530 may be used to draw first fluid from beneath the MCE 500 and expel the first fluid laterally through end portions of the MCE 500, or vice versa. In general, the purpose of the agitator 530 is to increase movement of the first fluid through the fluid tank 520 to improve heat transfer between the first fluid in the fluid tank 520 and second fluid in the MCE 500. The agitator 530 may be used in connection with the various embodiments of the MCE 200, 300, and 400 described above.

Each of the MCEs 200, 300, 400, and 500 described above may be made from various materials. In some embodiments, the MCEs 200, 300, 400, and 500 may be constructed out of aluminum. In other embodiments, the MCEs 200, 300, 400, and 500 may include a protective coating that protects the MCEs 200, 300, 400, and 500 from the fluid being cooled. Various types of protective coatings may be used depending on the type of first fluid being cooled. For example, the protective coating may be nickel, epoxy, or the like.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. A heat exchanger system comprising:

a fluid tank;

a lid adapted to seal the fluid tank and comprising a first-fluid inlet to permit a first fluid to enter the fluid tank and a first-fluid outlet to permit the first fluid to exit the fluid tank;

a microchannel evaporator disposed within the fluid tank, the microchannel evaporator comprising:

a plurality of microchannels, each microchannel of the plurality of microchannels comprising a first end portion that terminates in a first end and a second end portion that terminates in a second end;

a first end-tank coupled to each said first end portion of the plurality of microchannels;

a second end-tank coupled to each said second end portion of the plurality of microchannels, wherein the first end-tank and the second end-tank are disposed in the fluid tank;

a second-fluid inlet coupled to the first end-tank for receiving a second fluid into the microchannel evaporator;

a second-fluid outlet coupled to the second end-tank for expelling the second fluid from the microchannel evaporator; and a plurality of baffles positioned within the fluid tank, wherein the plurality of baffles comprise:

a first baffle disposed between the first and second end portions of the plurality of microchannels, the first baffle directs the first fluid to flow past the plurality of microchannels a first time;

a second baffle that causes the first fluid to flow past the plurality of microchannels a second time;

a third baffle that causes the first fluid to flow past the plurality of microchannels a third time; and wherein the first baffle, the second baffle, and the third baffle divide the fluid tank into eight chambers.

2. The heat exchanger system of claim 1, wherein the first baffle comprises a first planar portion extending in a first direction from a first end of the fluid tank to a second end of the fluid tank and a second planar portion extending in a second direction between the first and second end portions of the plurality of microchannels, wherein the first baffle comprises a cutout through which the plurality of microchannels pass.

3. The heat exchanger system of claim 1, wherein the first end portion is parallel to the second end portion, and the first end portion and the second end portion are joined together by a single bend to form a U shape.

4. The heat exchanger system of claim 1, wherein the second-fluid outlet comprises a diameter that is larger than a diameter of the first-fluid inlet.

5. The heat exchanger system of claim 1, comprising at least one fin disposed in a first gap of the plurality of microchannels.

6. The heat exchanger system of claim 5, wherein the at least one fin extends along only a portion of a length of a microchannel of the plurality of microchannels.

7. The heat exchanger system of claim 1, wherein said each microchannel of the plurality of microchannels has a rectangular cross-section.

8. The heat exchanger system of claim 1, comprising a cooling system coupled to the microchannel evaporator for cooling the second fluid.

9. The heat exchanger system of claim 1, wherein the first fluid comprises oil and the first fluid is circulated between an external machine and the fluid tank to reject heat.

10. The heat exchanger system of claim 1, wherein the second fluid comprises a refrigerant.

11. The heat exchanger system of claim 1, wherein the second fluid comprises a coolant.

12. The heat exchanger system of claim 1, wherein the microchannel evaporator comprises a plurality of fins disposed in a first gap of the plurality of microchannels, and wherein the plurality of fins are spaced so that there are between 5 and 8.5 fins per inch.

13. A microchannel evaporator disposed within a fluid tank of a heat exchanger system, the microchannel evaporator comprising:

a plurality of microchannels, each microchannel of the plurality of microchannels comprising a first end portion that terminates in a first end and a second end portion that terminates in a second end;

a first end-tank coupled to each said first end portion of the plurality of microchannels;

a second end-tank coupled to each said second end portion of the plurality of microchannels, wherein the first end-tank and the second end-tank are disposed in the fluid tank;

a second-fluid inlet coupled to the first end-tank for receiving a second fluid into the microchannel evaporator;

a second-fluid outlet coupled to the second end-tank for expelling the second fluid from the microchannel evaporator; and a plurality of baffles positioned within the fluid tank, wherein the plurality of baffles comprise:

a first baffle disposed between the first and second end portions of the plurality of microchannels, the first baffle directs a first fluid to flow past the plurality of microchannels a first time;

a second baffle that causes the first fluid to flow past the plurality of microchannels a second time;

a third baffle that causes the first fluid to flow past the plurality of microchannels a third time; and wherein the first baffle, the second baffle, and the third baffle divide the fluid tank into eight chambers.

14. The microchannel evaporator of claim 13, wherein the heat exchanger system comprises:

the fluid tank; and a lid adapted to seal the fluid tank and comprising a first-fluid inlet to permit the first fluid to enter the fluid tank and a first-fluid outlet to permit the first fluid to exit the fluid tank.

15. The heat exchanger system of claim 14, wherein the first baffle comprises a first planar portion extending in a first direction from a first end of the fluid tank to a second end of the fluid tank and a second planar portion extending in a second direction between the first and second end portions of the plurality of microchannels, wherein the first baffle comprises a cutout through which the plurality of microchannels pass.

16. The heat exchanger system of claim 14, wherein the first end portion is parallel to the second end portion, and the first end portion and the second end portion are joined together by a single bend to form a U shape.

17. The heat exchanger system of claim 14, wherein the second-fluid outlet comprises a diameter that is larger than a diameter of the first-fluid inlet.

18. The heat exchanger system of claim 14, comprising at least one fin disposed in a first gap of the plurality of microchannels.

* * * * *